US008143176B2

(12) United States Patent
Weber et al.

(10) Patent No.: US 8,143,176 B2
(45) Date of Patent: Mar. 27, 2012

(54) TEXTILE TWO OR THREE DIMENSIONAL FABRIC CONTAINING MATERIALS THAT ARE CAPABLE OF SWELLING

(75) Inventors: Manfred Weber, Mannheim (DE); Axel Weiss, Speyer (DE); Eberhard Schupp, Gruenstadt (DE); Pulakesh Mukherjee, Mannheim (DE); Ralf Mossbach, Lindenberg (DE); Bernd Reck, Gruenstadt (DE); Kuno Beutler, Lambsheim (DE); Tibor Duris, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 1315 days.

(21) Appl. No.: 11/722,271

(22) PCT Filed: Dec. 21, 2005

(86) PCT No.: PCT/EP2005/013762

§ 371 (c)(1),
(2), (4) Date: Jun. 20, 2007

(87) PCT Pub. No.: WO2006/069689

PCT Pub. Date: Jul. 6, 2006

(65) Prior Publication Data

US 2010/0041291 A1 Feb. 18, 2010

(30) Foreign Application Priority Data

Dec. 22, 2004 (DE) ..... 10 2004 063 004

(51) Int. Cl.
*B32B 27/04* (2006.01)

(52) U.S. Cl. ..... 442/119; 442/118; 427/427.4

(58) Field of Classification Search ..... 442/118, 442/152, 164, 172, 119
See application file for complete search history.

(56) References Cited

U.S. PATENT DOCUMENTS

| | | | | |
|---|---|---|---|---|
| 2,015,102 | A | 9/1935 | Doig | |
| 2,160,342 | A | 5/1939 | Ribble | |
| 3,940,535 | A | 2/1976 | Gaeth et al. | |
| 2003/0045198 | A1 * | 3/2003 | Tanaka et al. | 442/417 |
| 2006/0069367 | A1 * | 3/2006 | Waksmundzki et al. | 604/378 |

FOREIGN PATENT DOCUMENTS

| | | |
|---|---|---|
| DE | 1 223 407 | 8/1966 |
| DE | 2 114 371 | 10/1972 |
| DE | 2 257 393 | 6/1974 |
| DE | 28 19 604 | 11/1979 |
| DE | 29 49 475 | 6/1981 |
| DE | 196 25 245 | 8/1998 |
| DE | 1 99 30 701 | 1/2001 |
| EP | 1 396 573 | 3/2004 |
| JP | 5 162258 | 6/1993 |
| WO | 2005 075544 | 8/2005 |

OTHER PUBLICATIONS

U.S. Appl. No. 12/518,282, filed Jun. 9, 2009, Krueger, et al.

* cited by examiner

*Primary Examiner* — Lynda Salvatore
(74) *Attorney, Agent, or Firm* — Oblon, Spivak, McClelland, Maier & Neustadt, L.L.P.

(57) ABSTRACT

The present invention relates to textile two- or three-dimensional structures formed from fibers and/or ribbons and swellable materials, the fibers and/or ribbons present in the structure and also the swellable materials each being present in such an amount that the fibers and/or ribbons are encased by the swellable materials and the voids in the structure are, in the swollen state, partially or completely filled by materially bound water and the swellable materials used being aqueous emulsions of (co)polymers of at least one ethylenically unsaturated monomer MON which are applied to the fibers and/or ribbons.

18 Claims, No Drawings

TEXTILE TWO OR THREE DIMENSIONAL FABRIC CONTAINING MATERIALS THAT ARE CAPABLE OF SWELLING

The present invention relates to textile two- or three-dimensional structures formed from fibers and/or ribbons and swellable materials, the fibers and/or ribbons present in the structure and also the swellable materials each being present in such an amount that the fibers and/or ribbons are encased by the swellable materials and the voids in the structure are, in the swollen state, partially or completely filled by materially bound water and the swellable materials used being aqueous emulsions of (co)polymers of at least one ethylenically unsaturated monomer MON which are applied to the fibers and/or ribbons.

The present invention further relates to a process for producing the present invention's two- or three-dimensional structures formed from fibers and/or ribbons and swellable materials and also to their use for example as sealing materials for cables, in particular electrical and communications cables, for road, tunnel and water engineering and also for excavations, high-water protection, groundwater protection and roof-sealing systems, and also to the use of the aqueous emulsion of (co)polymers of at least one ethylenically unsaturated monomer MON for producing textile two- or three-dimensional structures.

Cables, in particular electrical and communications cables, react very sensitively to moisture which enters the individual cable strands through a defect in the plastics sheathing. In such cases, the water can migrate very long distances in the cable and damage it over its full length. To avoid this, swellable material such as SAP powder (Super Absorbent Polymers, described for example in F. L. Buchholz, Modern Superabsorbent Technology, Wiley-VCH, 1998) is used alone or in combination with nonwovens or textiles as a supporting material between the cable and the outer plastics sheath. If a small crack in the cable sheath appears, even minimal quantities of water are sufficient to cause the SAP to swell. The swelling pressure seals the hole and prevents further migration of the water.

There are many areas in building construction practice where built structures need to be sealed off against penetrating surface, ground, stratum or leachate water. Devices used for sealing include weldable bituminous membranes (U.S. Pat. No. 2,015,102, U.S. Pat. No. 2,160,342), plastics seals (DE-A 19930701), foam ribbons (DE-A 2819604, DE-B 1223407) or clay sealing membranes.

Plastics sealing membranes and nonuniformly adhered bituminous seals have the disadvantage that water which penetrates in the event of damage can spread more or less unhindered between sealing layer and the built structure. Particularly in the case of concrete structures water which has percolated underneath the sealing layer will then penetrate the concrete at porous places or cracks. Rust is formed on the reinforcing steel. Damp places form on the inner surface of walls and ceilings. Furthermore, water can percolate through to the joints and emerge there.

Clay sealing membranes usually utilize bentonite sealing material, which, unlike the geotextiles frequently used as a carrier material, is not filter stable. Bentonite can be washed off by percolating water, as a result of which the sealing effect is lost. In contrast, clay sealing membranes prevent the longitudinal percolation of penetrated water by virtue of the bentonite which exits from the surface on swelling.

There are two recognized ways to seal off cellars, underground carparks, groundwater tanking systems or similar built structures against the external pressure of water from soil layers, for example hillside water or groundwater in building and civil engineering.

The usual choice is the white tanking system, which utilizes waterproof concrete, costly additional reinforcement to avoid cracks and tape to seal the joints between the individual components or construction joints. Any cracks which appear nonetheless are injected with resin.

The black tanking system is so called because of the bituminous sealing membranes typically used. But lately plastics seals have come to be used as well (DE-A 19930701).

Clay sealing membranes are used for brown tanking systems. Here the disadvantage of poor filter stability is taken advantage of by having the bentonite from the clay sealing membrane being washed into porous concrete to seal off the latter.

Office and industrial buildings usually have flat roofs. Flat roofs are less commonly used for residential buildings, since the risk of leakages is considerable. By reason of vapor diffusion, flat roof seals are only secured at points or along lines. In the event of the seal being damaged, the incoming water will easily spread out underneath the seal and lead to wet areas and building damage.

In tunnel construction a seal is needed to protect the built structure itself. But dripping water also poses a risk to the tunnel user through black ice being formed in road tunnels or short-circuiting in electrified railroad tunnels.

In the case of tunnels which have been built in open construction, the concrete structures have to be protected against the water which percolates through the later filling. Again, after damage to the seal, water is able to spread out between the seal and the concrete ceiling it then reemerges in cracks, weak areas or at the joints.

Tunnels which have been mechanically bored/milled or driven by mining can extend very far below the groundwater level. The seal then has to bear enormous pressures.

The high water pressure disperses the water far below the damaged seal.

In roadbuilding earthworks, the road structure has to be sealed off against the pervious substrate in water pollution control areas. This is often done these days using clay sealing membranes notwithstanding the well-known disadvantages with regard to filter stability and the jointing technique for membrane abutments. The clay sealing membrane has to be installed such that it is safe from frost and drying out.

Rainwater retention and settling basins or sludge ponds located in pervious soils are given a sealing system formed from plastics sealing membranes and protective liners. To allow access to maintenance equipment, it is often necessary to install a concrete floor.

As the concrete floor is being made, cement sludge will penetrate the protective liners above the sealing membrane and harden, as a result of which the liners, which are nonwovens, lose some of their protective function. The texture, which is now rough, abrades the liner in the event of movements, for example due to thermal expansion on the surface of the seal.

When such basins are sealed using clay sealing membranes, these have to be covered over with soil material to a sufficient depth to ensure frost control and avoid drying out.

Irrigation or power plant channels frequently have concrete or bitumen seals installed. These are given an additional seal of plastics sealing membranes or else clay sealing membranes. Again, the same problems arise as with the retention basins.

The individual plastics sealing membranes are installed by welding them together overlappingly by a strip adhered across the gap in the joint. Clay sealing membranes are laid with overlap. The joint of the overlap has bentonite powder sprinkled or a bentonite paste worked into it.

Seals applied atop a surface of a built structure offer no protection against underseepage after damage to the seal. No protective nonwovens are installed between the surface and the seals according to the present status of the art, since in the event of a seal being damages the protective nonwovens would distribute the incoming water over the whole area owing to their horizontal perviousness.

Nonwoven-protected sealing membranes which have been placed on top or have been installed in the soil are subject to water pressure from above or below. Vertical perviousness is the issue here. In the case of sealing membranes composed of different products, for example clay sealing membranes, care has to be taken to ensure that the sealing specialty clay cannot be washed off the carrier material of the protective nonwoven.

DE-A 19625245 discloses multi-ply seals for hollow spaces such as tunnels for example that comprises sealing membranes composed of plastics and a ply layer between the sealing membranes. The ply layer incorporates chemical or mineral fillers capable of substantial swelling. But the seals described here are still in need of improvement with regard to their barrier action against water ingress.

The present invention further relates to a process for producing the present invention's two- or three-dimensional structures from fibers and/or ribbons and swellable materials and also to their use for example as absorbing materials for hygiene articles, garden and landscape engineering, packaging materials, general and medical wastes and the building construction industry, and also to the use of the aqueous emulsion of (co)polymers of at least one ethylenically unsaturated monomer MON for producing textile two or three-dimensional structures.

SAP powders and nonwovens are employed in many hygiene segments such as infant care, adult incontinence and feminine hygiene. The nonwoven acts as a transfer layer whereby the fluid to be absorbed is distributed over the entire area and optimal utilization of the swellable material is thus made possible.

Swellable materials are exceedingly useful for applications in garden and landscape engineering. They take up water, are capable of holding it and also of readily releasing it again to the roots of the plants. Since water uptake and release are reversible, the swellable material retains these properties for a prolonged period. Swellable materials thereby appreciably enhance the plants' resistance to underwatering and drought. The number of irritations required is much reduced, resulting in a lower consumption of water. In addition, the soil remains loose as a result of the swelling and shrinking in the course of water uptake and release. The roots get more air.

The absorption capability can also be utilized for packaging foods. Fluids emerging from foods are securely encapsulated by the swellable material. As a result of the water being retained in the polymer, they remain in the same state and cool for longer.

The solidification of liquid wastes, in particular medical wastes, using absorbent material is a clean and dry solution and makes for simpler disposal of liquid wastes.

The absorbing properties also make the absorbent material a very good choice for the production of compresses, in plasters or wound dressings to absorb all exudates, and thereby helps to keep the wound dressings hygienically clean.

The absorption and solidification of aqueous solution can improve their handling and reduce the risk of environmental pollution through leaks and escaped liquids during storage, transportation and eventually disposal. Many kinds of waste material can be treated in this way, including wastewater, sewage sludge and sludge deposits in rivers and also radioactive waste.

As well as being useful for the treatment of liquids or fluids, the swellable material can serve as a cat litter replacement. The weight reduction is advantageous as well as the absorptive capacity.

In the building construction industry, swellable material can not only provide the above-described closeout properties but also, through admixture into building materials such as concrete for example, lead to improved strength and durability for the hardened concrete produced. The constitution of the concrete mass can be varied through the controlled addition of the swellable material.

As well as (liquid) water, absorbent polymers are also capable of taking up water vapor. This property can be utilized to control the relative humidity. Absorbent polymers are capable of taking up more moisture from the air, and re-releasing it, than inorganic materials, on a mass against mass comparison. The ability of swellable materials to regulate relative humidity can be used for preventing condensation forming on the ceilings and rooms of damp buildings.

Pulverulent swellable materials have disadvantages in the applications described above. The powders are not bound to supporting substrates and so are mobile. The distribution of the swellable material is not homogeneous but localized. Incorporating the swellable material into the support is costly and inconvenient.

The combination of swellable polymer and nonwoven binds the swellable polymer to the fiber of the nonwoven. The swellable polymer is consequently completely immobile, which is coincident with a uniform distribution of the absorbent material. Consequently, no powder can escape in the applications described. The material can be handled in roll form.

The present invention therefore has for its object to remedy the disadvantages described and to provide a novel sealing/absorbing structure which, inter alia, shall have a high protective function for adjacent layers, especially layers composed of plastics material, and which shall also be notable for the fact that uncontrolled propagation of water underneath the seal does not cause any damage to adjacent layers. The novel sealing structure shall further be impervious to water pressure at right angles to the product face.

It shall further be capable of absorbing a multiple of its own weight of liquid and of storing the liquid even under an appreciable pressure. As well as (liquid) water, the structure shall be capable of taking up water vapor.

We have found that the present invention's object is achieved by novel textile two- or three-dimensional structures formed from fibers and/or ribbons and swellable materials, the fibers and/or ribbons present in the structure and also the swellable materials each being present in such an amount that the fibers and/or ribbons are encased by the swellable materials and the voids in the structure are, in the swollen state, partially or completely filed by materially bound water and the swellable materials used being aqueous emulsions of (co)polymers of at east one ethylenically unsaturated monomer MON wherein at least one aqueous dispersion is produced in the presence of at least one water-soluble polymer, at east one water-soluble polymer being selected from (a1) graft polymers of vinyl acetate and/or vinyl propionate on polyalkylene glycol or one- or bothsidedly alkyl-, carboxyl- or amino-substituted polyalkylene glycol, (a2) copolymers of alkylpolyalkylene glycol (meth)acrylates and (meth)acrylic acid, (a3) polyalkylene glycols, (a4) one- or bothsidedly alkyl-, carboxyl- or amino-substituted polyalkylene glycols, and at least one water-soluble polymer being selected from (b1) hydrolyzed copolymers of vinyl alkyl ethers and maleic anhydride as a free polyacid or at least partially neutralized with alkali metal hydroxides or ammonium bases, (b2) starch, modified or unmodified, (b3) synthetic copolymers obtainable by copolymerization of (β1) one or more nonionic monoethylenically unsaturated monomers, (β2) one or more cationic monoethylenically unsaturated monomers, (β3) optionally one or more anionic monoethylenically unsaturated monomers, the molar fraction of cationic monoethylenically unsaturated monomers (β2) interpolymerized in (b3) being higher than the fraction of interpolymerized anionic monoethylenically unsaturated monomers (β3).

Furthermore, the invention provides an improved process for preparing the textile structures of the invention. The invention moreover provides on the basis of the textile structures of the invention improved sealing materials for road, tunnel and water engineering and also for excavations, high-water protection and roof sealing systems. The present invention also extends to the use of the aqueous polymer emulsions for producing the textile structures according to the invention.

Useful two- or three-dimensional structures include corresponding nonwovens, formed-loop knits, wovens or drawn-loop knits or combinations thereof. Nonwoven customary refers to a structure which has not been woven nor loop-formingly knitted and which may contain fibers or ribbons. Formed-loop knits are textile structures formed by forming mutually supporting loops, ovens are textile structures formed of yarns or ribbons which cross at right angles on weaving machines. The two- or three-dimensional structures of the present invention are preferably present in the form of wovens or nonwovens. Useful nonwovens include spunbonded nonwovens, needled nonwovens or else hydroentangled nonwovens. The nonwovens may be consolidated mechanically, thermally or chemically. The structures according to the invention may be made not only substantially two-dimensionally, i.e., sheetlike, but also substantially three-dimensionally, i.e., with an appropriate thickness.

The textile two or three-dimensional structures according to the invention may be formed of ribbons or of fibers, in which case the latter are preferred. Useful ribbons include especially those composed of textile materials or film ribbons composed of customary film materials, for example of plastics such as polyethylene or polypropylene. The fibers used may be staple fibers or continuous fibers (fragments). The fibers may be inter alia synthetic, mineral or natural in kind, in which case especially synthetic or mineral fibers are used. Examples of useful synthetic fibers include fibers composed of polyethylene, polypropylene polybutylene terephthalate, polyamide, polyethylene terephthalate, polyester, polysulfone or polyether ketone. Mineral fibers may be composed inter alia of ceramic materials, silicon carbide or of boron nitride. It is also conceivable to use fibers composed of carbon or glass fibers.

The fibers and/or ribbons present in the textile structures and also the swellable materials are each present in such an amount that the fibers and/or ribbons are encased by the swellable materials and the voids in the structure are completely filed with materially bound water in the swollen state. With regard to the amount of swellable materials, it is customary to use from 0.05 to 20 kg and especially from 0.1 to 10 kg of these swellable materials per $m^2$ of ready-produced swellable nonwoven. As regards the amount of fibers and/or ribbons per $m^2$ of ready-produced swellable nonwoven, it is customarily in the range from 0.1 to 2 kg and especially in the range from 0.15 to 1 kg.

To achieve water imperviousness in the horizontal plane, the textile structure of the present invention has to be drenched with the swellable materials in such a way that complete encasement of the fibers is achieved.

Impregnation of the textile structures with the present invention's emulsion and subsequent drying at temperatures of 120 (PP nonwoven)-160° C. creates a high absorbency swellable nonwoven capable of taking up a multiple, i.e., up to several 100%, of its own weight of water within a short period.

The swellable materials used are aqueous emulsions of (co)polymers of at least one ethylenically unsaturated monomer MON wherein at least one aqueous dispersion is prepared in the presence of at least one water-soluble polymer, at least one water-soluable polymer being selected from (a1) graft polymers of vinyl acetate and/or vinyl propionate on polyalkylene glycol or one- or bothsidedly alkyl-, carboxyl- or amino-substituted polyalkylene glycol, (a2) copolymers of alkylpolyalkylene glycol (meth)acrylates and (meth)acrylic acid, (a3) polyalkylene glycols, (a4) one- or bothsidedly alkyl-, carboxyl- or amino-substituted polyalkylene glycols, and at least one water-soluble polymer being selected from (b1) hydrolyzed copolymers of vinyl alkyl ethers and maleic anhydride as a free polyacid or at least partially neutralized with alkali meta hydroxides or ammonium bases, (b2) starch, unmodified or preferably cationically or anionically modified, (b3) synthetic copolymers obtainable by copolymerization of (β1) one or more nonionic monoethylenically unsaturated monomers, (β2) one or more cationic monoethylenically unsaturated monomers, (β3) optionally one or more anionic monoethylenically unsaturated monomers, the molar fraction of cationic monoethylenically unsaturated monomers (β2) interpolymerized in (b3) being higher than the fraction of interpolymerized anionic monoethylenically unsaturated monomers (β3).

The preparation of herein utilized aqueous emulsions of (co)polymers of at least one ethylenically unsaturated monomer MON will now be described.

Aqueous dispersions for the purposes of the present invention are aqueous solutions, suspensions and preferably emulsions.

Useful ethylenically unsaturated monomers MON include for example nitrogenous water-soluble ethylenically unsaturated monomers and anionic ethylenically unsaturated monomers.

Useful nitrogenous water-soluble ethylenically unsaturated monomers include for example homopolymers of N-vinylformamide, N-vinylacetamide, N-vinylimidazole and N-vinylpyrrolidone or copolymers of two or more of the aforementioned monomers.

Useful anionic ethylenically unsaturated monomers include for example:

monoethylenically unsaturated $C_3$- to $C_5$-carboxylic acids, for example monoethylenically unsaturated $C_3$- to $C_5$-mono- and dicarboxylic acids such as acrylic acid, methacrylic acid, ethacrylic acid, crotonic acid maleic acid or fumaric acid, vinylsulfonic acid, styrenesulfonic acid, especially para styrenesulfonic acid acrylamidomethylpropanesulfonic acid, for example

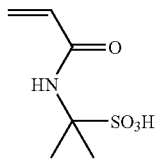

vinylphosphonic acid

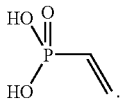

The aforementioned ethylenically unsaturated anionic monomers can each be utilized as a free acid or in the form of their alkali metal or ammonium salts.

Preferred ethylenically unsaturated anionic monomers include (meth)acrylic acid, maleic acid and acrylamidomethylpropanesulfonic acid, and acrylic acid is particularly preferred.

Ethylenically unsaturated anionic monomers can be polymerized to form homopolymers or else mixed with each or one another or with other comonomers to form copolymers. Examples are the homopolymers of acrylic acid or copolymers of acrylic acid with methacrylic acid and/or maleic acid.

However, the (co)polymerization of the aforementioned ethylenically unsaturated anionic monomers can also be carried out in the presence of at least one ethylenically unsaturated comonomer which is nonionic or can bear a positive charge, i.e., is cationic. Examples of suitable nonionic or cationic comonomers are (meth)acrylamide, acrylic esters of $C_1$-$C_4$ alkanols, for example methyl acrylate, ethyl acrylate, n-propyl acrylate, isopropyl acrylate, n-butyl acrylate, isobutyl acrylate, sec-butyl acrylate, sec-butyl acrylate, tert-butyl acrylate, methacrylic esters of methanol or ethanol, vinyl acetate, vinyl propionate, mono- or diallyldi($C_1$-$C_4$-alkyl) ammonium salts, especially halides of the formula

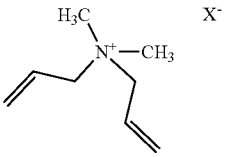

where $X^-$ is selected from for example fluoride, bromide, iodide and especially chloride, 2-[N,N-di($C_1$-$C_4$-alkyl) amino]ethyl (meth)acrylates, 3-[N,N-di($C_1$-$C_4$-alkyl)aminopropyl (meth)acrylates, where each $C_1$-$C_4$-alkyl may be different or preferably the same and selected from ethyl, n-propyl, isopropyl, n-butyl, isobutyl and preferably methyl, very particular preference being given to 2-(N,N-dimethylamino)ethyl (meth)acrylate and 3-(N,N-dimethyl)aminopropyl (meth)acrylate, N-vinylimidazole or $C_1$-$C_4$ alkyl- or benzyl-quaternized N-vinylimidazole, useful counter ions including for example halide, especially bromide or chloride, or hydrogensulfate.

Basic comonomers such as 2-[N,N-di($C_1$-$C_4$-alkyl)amino ethyl (meth)acrylates and 3-[N,N-di($C_1$-$C_4$-alkyl)aminopropyl (meth)acrylates can be used in the copolymerization not only in the form of the free bases but also in partially or fully buffered form.

Nonionic and/or cationic comonomers can preferably be added in such amounts in the course of the preparation of the copolymers to be used according to the present invention that the resulting copolymers are water-soluble and have a net anionic charge, which may each be stabilized for example by alkali metal cations or ammonium cations, which may be substituted. Based on the total amount of comonomers used in the course of the copolymerization, the amount of nonionic and/or cationic comonomers can be for example in the range from 0% to 99% and preferably in the range from 5% to 45% by weight.

Preferred copolymers are for example copolymers of from 55% to 90% by weight of acrylic acid and from 45% to 10% by weight of acrylamide.

A specific embodiment of the present invention utilizes crosslinked copolymers as (co)polymers of at least one ethylenically unsaturated anionic monomer.

Crosslinked copolymers can be prepared by conducting the copolymerization in the additional presence of at least one crosslinker. Copolymers are then obtained with a higher molecular weight than when (co)polymerizing at least one ethylenically unsaturated monomer MON in the absence of a crosslinker. Crosslinked copolymers prepared in this way have a high water uptake capacity. Useful crosslinkers include all compounds having two or more ethylenic double bonds in the molecule. Such compounds are used for example in the preparation of crosslinked polyacrylic acids such as superabsorbent polymers, cf. EP-A 858 478. Examples of particularly suitable crosslinkers are:

triallylamine, pentaerythritol triallyl ether, methylenebis (meth)acrylamide, N,N'-divinylethyleneurea, fully acrylated or methacrylated dihydric or more highly hydric alcohols having 2 to 4 carbon atoms such as ethylene glycol di(meth) acrylate, 1,4-butanediol di(meth)acrylate, di(meth)acrylates of polyethylene glycols having molecular weights $M_n$ of for example 300 to 600 g/mol, compounds of the general formula I

I

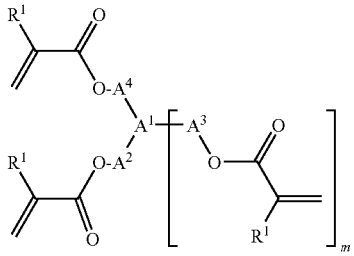

in each of which the variables are defined as follows:

$R^1$ is in each occurrence the same or different and selected from methyl and hydrogen;

m is an integer from 0 to 2 and preferably 1;

$A^1$ is $CH_2$ or —$CH_2$—$CH_2$— or $R^2$—CH or para-$C_6H_4$ when m=0,

CH, $R^2$—C or 1,3,5-$C_6H_3$ when m=1, and carbon when m=2;

$R^2$ is selected from $C_1$-$C_4$-alkyl, such as for example n-$C_4H_9$, n-$C_3H_7$, iso-$C_3H_7$ and preferably $C_2H_5$ and $CH_3$, or phenyl, $A^2$, $A^3$ and $A^4$ are the same or different and each is selected from $C_1$-$C_{20}$-alkylene, such as for example —$CH_2$—, —$CH(CH_3)$—, —$CH(C_2H_5)$—, —$CH(C_6H_5)$—, —$(CH_2)_2$—, —$(CH_2)_3$—, —$(CH_2)_4$—, —$(CH_2)_5$—, —$(CH_2)_6$—, —$(CH_2)_7$—, —$(CH_2)_8$—, —$(CH_2)_9$—, —$(CH_2)_{10}$—, —$CH(CH_3)$—$(CH_2)_2$—$CH(CH_3)$—;

cis- or trans-$C_4$-$C_{10}$-cycloalkylene, such as for example cis-1,3-cyclopentylidene, trans-1,3-cyclopentylidene, cis-1,4-cyclohexylidene, trans-1,4-cyclohexylidene;

$C_1$-$C_{20}$-alkylene in which from one to seven nonadjacent carbon atoms are replaced by oxygen, such as for example —$CH_2$—O—$CH_2$—, —$CH_2$—$CH_2$—O, —$(CH_2)_2$—O—$CH_2$—, —$(CH_2)_2$—O—$(CH_2)_2$—, —$[(CH_2)_2$—$O]_2$—$(CH_2)_2$—, —$[(CH_2)_2$—$O]_3$—$(CH_2)_2$—;

$C_1$-$C_{20}$-alkylene substituted with up to 4 hydroxyl groups and having from one to seven nonadjacent carbon atoms replaced by oxygen, such as for example —$CH_2$—O—$CH_2$—$CH(OH)$—$CH_2$, —$CH_2$—O—$[CH_2$—$CH(OH)$—$CH_2]_2$—, —$CH_2$—O—$[CH_2$—$CH(OH)$—$CH_2]_3$—;

$C_6$-$C_{14}$-arylene, such as for example para-$C_6H_4$, and also 2,2-bis(hydroxymethyl)butanol tri(meth)acrylate, pentaerythritol tri(meth)acrylate, pentaerythritol tetraacrylate and triallylmethylammonium chloride.

When one or more crosslinkers are to be used in the preparation of (co)polymers of at least one ethylenically unsaturated monomer MON, the amount of crosslinker used in each case will be for example in the range from 0.0005% to 5.0% and preferably from 0.001% to 1.0% by weight, based on the total mass of ethylenically unsaturated monomers MON used in the (co)polymerization.

The (co)polymerization is typically initiated using polymerization initiators which form free radicals under the reaction conditions. Useful polymerization initiators include for example peroxides, hydroperoxides, hydrogen peroxide, redox catalysts and azo compounds such as 2,2'-azobis(N,N-dimethyleneisobutyramidine) dihydrochloride, 2,2'-azobis (4-methoxy-2,4-dimethylvaleronitrile), 2,2'-azobis(2,4-dimethylvaleronitrile) and 2,2'-azobis(2-amidinopropane) dihydrochloride. Polymerization initiators are used in customary amounts for (co)polymerizations. It is preferable to use azo initiators as polymerization initiators. However, the (co)polymerization can also be initiated by means of high energy rays such as electron beams or by irradiation with UV light.

One embodiment of the present invention utilizes aqueous emulsions of (co)polymers of at least one ethylenically unsaturated monomer MON having a (co)polymer concentration of for example from 1% to 50% by weight, preferably from 10% to 30% by weight and especially from 15% to 25% by weight. The (co)polymer concentration can also be referred to as solids content.

Emulsions used according to the present invention are prepared in the presence of at least one water-soluble polymer, at least one water-soluble polymer being selected from (a1) graft polymers of vinyl acetate and/or vinyl propionate on polyalkylene glycol or one- or bothsidedly alkyl-, carboxyl or amino substituted polyalkene glycol, (a2) copolymers of alkylpolyalkylene glycol (meth)acrylates and (meth)acrylic acid, (a3) polyalkylene glycols, (a4) one- or bothsidedly alkyl-, carboxyl- or amino-substituted polyalkylene glycols, and at least one water-soluble polymer being selected from (b1) hydrolyzed copolymers of vinyl alkyl ethers and maleic anhydride as a free polyacid or at least partially neutralized with alkali metal hydroxides or ammonium bases, (b2) starch, unmodified or preferably cationically or anionically modified, (b3) synthetic copolymers obtainable by copolymerization of (β1) one or mere nonionic monoethylenically unsaturated monomers, (β2) one or more cationic monoethylenically unsaturated monomers, (β3) optionally one or more anionic monoethylenically unsaturated monomers, the molar fraction of cationic monoethylenically unsaturated monomers (β2) interpolymerized in (b3) being higher than the fraction of interpolymerized anionic monoethylenically unsaturated monomers (β3).

Emulsions used according to the present invention may likewise be prepared in the presence of at least two water-soluble polymers different from those mentioned above.

The amount of water-soluble polymers in aqueous dispersions used according to the present invention is in total for example in the range from 1% to 70% by weight, preferably in the range from 5% to 50% by weight and more preferably in the range from 10% to 25% by weight. The aqueous dispersions have, for example at a pH of 4.5, a dynamic viscosity in the range from 200 to 12 000 mPa·s and preferably in the range from 200 to 6000 mPa·s (as measured in a Brookfield viscometer at 20° C., spindel 6, 100 rpm).

As water-soluble polymer of group (a1) there may be used graft polymers of vinyl propionate or of mixtures of vinyl propionate and vinyl acetate, preferably of vinyl acetate on polyalkylene glycol, preferably polyethylene glycol or one or bothsidedly alkyl-, carboxyl- or amino-substituted polyalkylene glycol, preferably polyethylene glycol.

Polyalkylene glycols useful as a grafting base are described for example in WO-A-03/046024 page 4 line 37 to page 8 line 9. The grafting base is grafted for example with from 10 to 10 000 and preferably from 30 to 300 parts by weight of vinyl propionate, of mixture of vinyl propionate and vinyl acetate or preferably of vinyl acetate per 100 parts by weight of grafting base. Polyethylene glycol having a molecular weight $M_n$ in the range from 1000 to 100 000 g/mol is very particularly preferred for use as grafting base.

As water-soluble polymers of group (a2) there may be used copolymers of alkylpolyalkylene glycol (meth)acrylates and (meth)acrylic acid, preference being give to copolymers of alkylpolyalkylene glycol acrylates and (meth)acrylic acid. Such compounds are known as dispersants for cement for example. They are prepared by first esterifying addition products of ethylene oxide and/or propylene oxide onto for example $C_1$- to $C_{18}$-alcohols with acrylic acid and/or methacrylic acid and then copolymerizing the resultant esters with acrylic acid and/or methacrylic acid. Typically employed water-soluble polymers of group (a2) comprise for example from 5% to 60% by weight and preferably from 10% to 35% by weight of interpolymerized units of alkylpolyalkylene glycol (meth)acrylates and from 95% to 40% by weight and preferably from 90% to 65% by weight of interpolymerized units of (meth)acrylic acid. Their molecular weights $M_w$ are mostly in the range from 2000 to 50 000 and preferably in the range from 5000 to 20 000 g/mol. Water-soluble polymers of group (a2) can be used in the preparation of aqueous dispersions used according to the present invention in the form of the polyacids or else in fully or partially neutralized form. Carboxyl groups of the water-soluble polymers of group (a2)

may preferably be neutralized with aqueous sodium hydroxide solution, aqueous potassium hydroxide solution or ammonia.

Suitable water-soluble polymers (a3) are polyalkylene glycols, preferably polyethylene glycols.

Polyalkylene glycols and especially polyethylene glycols used as water-soluble polymer (a3) in one embodiment of the present invention can have a molecular weight $M_n$ in the range from 100 to 1000 g/mol, preferably in the range from 300 to 80 000 g/mol, more preferably in the range from 600 to 50 000 g/mol and especially in the range from 1000 to 50 000 g/mol, the molecular structure of polyalkylene glycols being defined above. Preferred polyalkylene glycols (a3) are polyethylene glycol, polypropylene glycol and also block copolymers of ethylene oxide and propylene oxide. Block copolymers may comprise interpolymerized units of ethylene oxide and propylene oxide in any desired amounts and in any desired order, and have two or more blocks.

Suitable water-soluble polymers (a4) are one- or bothsidedly alkyl, carboxyl- or amino-substituted polyalkylene glycols and especially polyethylene glycols, for example having molecular weights $M_n$ in the range from 100 to 100 000 g/mol, preferably in the range from 300 to 80 000 g/mol, more preferably in the range from 600 to 50 000 g/mol and especially in the range from 1000 to 50 000 g/mol. Preferred water-soluble polymers (a4) are one- or bothsidedly alkyl-, carboxyl- or amino-substituted polyethylene glycols, polypropylene glycols and also block copolymers of ethylene oxide and propylene oxide; block copolymers may comprise interpolymerized units of ethylene oxide and propylene oxide in any desired amounts and in any desired order, and have two or more blocks. Suitable alkyl groups are $C_1$-$C_{20}$-alkyl and especially unbranched $C_1$-$C_{20}$-alkyl. Suitable carboxyl groups are for example pivalate and propionate and especially acetate and also benzoate. Amino groups can be selected from $NH_2$ and mono- and di-$C_1$-$C_4$ alkylamine groups and cyclic amino groups such as for example

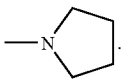

Aqueous dispersions used according to the present invention comprise at least one water-soluble polymer of groups (a1), a2), (a3) or (a4) for example in amounts from 2% to 15% and preferably from 5% to 12% by weight, based on total dispersion used according to the present invention. Water-soluble polymer of groups (a1), (a2), (a3) or (a4) is used in the preparation of dispersion used according to the present invention, preferably in the (co)polymerization.

As water-soluble polymers of group (b1) there are used preferably partially or quantitatively hydrolyzed copolymers of vinyl alkyl ethers, for example vinyl $C_1$-$C_4$-alkyl ethers, and maleic anhydride. $C_1$-$C_4$-Alkyl is selected from methyl, ethyl, n-propyl, iso-propyl, n-butyl, isobutyl, tert-butyl and preferably methyl or ethyl. Water-soluble polymers of group (b1) are obtainable by copolymerizing vinyl alkyl ethers with maleic anhydride and subsequent partial or quantitative hydrolysis of the anhydride groups to carboxyl groups and if appropriate partial or complete neutralization of the carboxyl groups. Particularly preferred water-soluble polymers of group (b1) are hydrolyzed copolymers of vinyl methyl ether and maleic anhydride as a free polyacid and in the form of salts at least partially neutralized with aqueous sodium hydroxide solution, aqueous potassium hydroxide solution or ammonia.

Suitable water-soluble polymers are (b2) starch, starch unmodified or preferably cationically or anionically modified. Examples of modified starches are cationically modified potato starch, anionically modified potato starch, degraded potato starch and maltodextrin. Examples of cationically modified potato starches are the commercial products Amylofax 15 and Perlbond 970. A suitable anionically modified potato starch is Perfectamyl A 4692. Here the modification consists essentially in a carboxylation of potato starch for example benzoate, pivalate and especially acetate. C*Pur 1906 is an example of an enzymatically degraded potato starch and Maltodextrin C 01915 is an exempt of hydrolytically degraded potato starch.

Further suitably water-soluble polymers are synthetic preferably random copolymers (b3), obtainable by copolymerization of (β1) at least one monomer selected from (meth)acrylamide, N-vinylformamide, N-vinylpyrrolidone and N-vinylcaprolactam, very particular preference being given to acrylamide and N-vinylpyrrolidone, and (β2) one or more cationic monoethylenically unsaturated monomers selected from di-$C_1$-$C_4$-alkylamino-$C_2$-$C_4$-alkyl (meth)acrylate, for example 2-(N,N-dimethylamino) ethyl (meth)acrylate, 3-(dimethylamino)propyl (meth) acrylate, 2-(N,N-diethylamino)ethyl (meth)acrylate, 3-(diethylamino)propyl (meth)acrylate, each partially or quantitatively neutralized with for example with halohydric acids such as for example hydrochoric acid, with sulfuric acid, paratoluenesulfonic acid, formic acid or acetic acid, or partially or quantitatively quaternized with $C_1$-$C_4$-alkyl or benzyl, for example through reaction with $C_1$-$C_4$ alkyl halide such as for example $C_1$-$C_4$ alkyl bromide or iodide, through reaction with di-$C_1$-$C_4$-alkyl sulfate or with benzyl halide such as for example benzyl bromide or benzyl chloride. Further suitable monomers (β2) are dimethyldiallylammonium chloride, diethyldiallylammonium chloride, dimethyldiallylammonium bromide, diethyldiallylammonium bromide.

One or more anionic monoethylenically unsaturated monomers (β3) can be interpolymerized as well, selected from (meth)acrylic acid, vinylsulfonic acid, vinylphosphonic acid, maleic acid, fumaric acid, itaconic acid, crotonic acid, each as a free acid or as an alkali metal or ammonium salt, the molar fraction of cationic monoethylenically unsaturated monomers (β2) interpolymerized in (b3) being higher than the fraction of interpolymerized anionic monoethylenically unsaturated monomers (β3).

Copolymers (b3) can have a K value in the range from 15 to 200, preferably in the range from 30 to 150 and more preferably in the range from 45 to 110, determined after H. Fikentscher (Celluose-Chemie, volume 13, 58-64 and 71-74, 1932) in 3% by weight aqueous NaCl solution at 25° C., a pH of 7 and a copolymer concentration of 0.1% by weight.

One embodiment of the present invention comprises synthetic preferably random copolymers (b3) constructed from 2 to 90, preferably 20 to 80 and more preferably 30 to 70 mol % of at least one monomer (β1), 2 to 90, preferably 20 to 80 and more preferably 30 to 70 mol % of at least one cationic monoethylenically unsaturated monomer (β2).

Another embodiment of the present invention comprises synthetic preferably random copolymers (b3) constructed from 2 to 90, preferably 10 to 80 and more preferably 20 to 70 mol % of at least one monomer (β1), 2 to 90, preferably 10 to 80 and more preferably 20 to 70 mol % of at least one cationic monoethylenically unsaturated monomer (β2), 0.1 to 8, preferably up to 10 and more preferably 20 mol % of at least one anionic monoethylenically unsaturated monomer (β3).

The solubility of comonomers (β1) in water at 25° C. is preferably not less than 100 g/l and most preferably they are miscible with water in any proportion.

Suitable examples of copolymers (b3) are those prepared by copolymerization of acylamide and 2-(N,N-dimethylaminoethyl acrylate methochloride, acrylamide and 2-(N,N-dimethylamino)ethyl methacrylate methochloride, methacrylamide and 2-(N,N-dimethylamino)ethyl acrylate methochloride, methacrylamide and 2-(N,N-dimethylamino) ethyl methacrylate methochloride, acrylamide, 2-(N,N-dimethylamino)ethyl acrylate methochloride and acrylic acid, acrylamide, 2-(N,N-dimethylamino)ethyl methacrylate methochloride and acrylic acid A particularly suitable water-soluble polymer is enzymatically degraded starch, especially maltodextrin.

Aqueous dispersions used according to the present invention comprise at least one water-soluble polymer of groups (b1), (b2) or (b3) for example in amounts from 2% to 15% and preferably from 5% to 12% by weight. Water-soluble polymer of groups (b1), (b2) or (b3) is used in the preparation of dispersion used according to the present invention. The ratio of water-soluble polymers of groups (a1), (a2), (a3) and (a4), as the case may be, to water-soluble polymers of groups (b1), (b2) and (b3), as the case may be, in the dispersions of the present invention is for example in the range from 1:5 to 5:1 and preferably in the range from 1:2 to 2:1.

Without wishing to be bound by one particular theory, initial results suggest that water-soluble polymers of groups (a1) to (a4) and (b1) to (b3) act as a stabilizer for aqueous dispersions used according to the present invention.

Herein used aqueous emulsions of (co)polymers of at least one ethylenically unsaturated monomer MON, for example of at least one ethylenically unsaturated anionic monomer or of at least one nitrogenous water-soluble ethylenically unsaturated monomer preferably comprise a combination of (a1) at least one graft polymer of vinyl acetate and polyethylene glycol with a molecular weight $M_n$ in the range from 1000 to 100 000 g/mol and (b1) at least one hydrolyzed copolymer of vinyl methyl ether and maleic anhydride as a polyacid or at least partially neutralized with aqueous sodium hydroxide solution, aqueous potassium hydroxide solution or ammonia.

A further preferred embodiment of the invention utilizes the following combination of water-soluble polymers:

(a2) at least one copolymer of alkyl polyalkylene glycol (meth)acrylate and (meth)acrylic acid and (b1) at least one hydrolyzed copolymer of vinyl methyl ether and maleic anhydride as a polyacid or at east partially neutralized with aqueous sodium hydroxide solution, aqueous potassium hydroxide solution or ammonia.

Further combinations of stabilizers for producing the aqueous dispersions of anionic polymers are for example mixtures of (a3) polypropylene glycols, polyethylene glycols, and/or block copolymers of ethylene oxide and propylene oxide with molecular weights $M_n$ in the range from 300 to 50 000 g/mol and/or (a4) one- or bothsidedly $C_1$- to $C_4$ alkyl substituted polypropylene glycols, polyethylene glycols and/or block copolymers of ethylene oxide and propylene oxide with a molecular weight $M_n$ in the range from 300 to 50 000 g/mol and (b3) synthetic copolymers obtainable by copolymerization of (β1) one or more nonionic monoethylenically unsaturated monomers, (β2) one or more cationic monoethylenically unsaturated monomers, (β3) optionally one or more anionic monoethylenically unsaturated monomers, the molar fraction of cationic monoethylenically unsaturated monomers (β2) interpolymerized in (b3) being higher than the fraction of interpolymerized anionic monoethylenically unsaturated monomers (β3).

In one embodiment of the present invention, herein used aqueous dispersions of (co)polymers of at least one ethylenically unsaturated monomer MON, for example of at least one ethylenically unsaturated anionic monomer or of at least one nitrogenous water-soluable ethylenically unsaturated monomer, have an average particle diameter in the range from 0.1 to 200 μm and preferably in the range from 0.5 to 70 μm.

In one embodiment of the present invention, herein used aqueous dispersions of (co)polymers of at least one ethylenically unsaturated monomer MON, for example at least one ethylenically unsaturated anionic monomer or of at least one nitrogenous water-soluble ethylenically unsaturated monomer, have a relatively low viscosity a pH values below 6 combined with a solids content of about 5% to 35% by weight. However, setting a solids content of 2% by weight causes the viscosity of the present invention's aqueous dispersion in question to rise substantially.

In one embodiment of the present invention, aqueous dispersions of at least one (co)polymer of at least one ethylenically unsaturated monomer MON, for example of at least one ethylenically unsaturated anionic monomer have an inorganic salt content in the range from 0.001% to 15% by weight and preferably in the range from 0.1% to 5% by weight, based on the solids content of the respective aqueous dispersion. In another embodiment of the present invention, aqueous dispersions of at least one (co)polymer of at least one ethylenically unsaturated monomer MON, for example of at least one ethylenically unsaturated anionic monomer do not have any measurable content of inorganic salts.

The emulsions to be used according to the present invention may further comprise customary additives for each application. They may comprise bactericides or fungicides for example. They may further comprise hydrophobicizers to enhance the water fastness of the substrates treated. Useful hydrophobicizers include customary aqueous paraffin dispersions or silicones. The compositions may further comprise wetting agents, thickeners, dispersions, plasticizers, retention aids, pigments and fillers. The admixing of these fillers may also be effected by induction heating to facilitate curing.

Surface-active auxiliaries can be used to stabilize the emulsions used to introduce the swellable materials, these emulsions being composed of organic solvents, water and the present invention's dispersions. Typically, emulsifiers or protective colloids are used as surface-active auxiliaries. Anionic, nonionic, cationic and amphoteric emulsifiers come into consideration. Examples of anionic emulsifiers are alkylbenzenesulfonic acids, sulfonated fatty acids, sulfosuccinates, fatty alcohol sulfates, alkylphenol sulfates and fatty alcohol ether sulfates. Useful nonionic emulsifiers include for example alkylphenol ethoxylates, primary alcohol ethoxylates, fatty acid ethoxylates, alkanolamide ethoxylates, fatty amine ethoxylates, EO-PO block copolymers and alkylpolyglucosides. As cationic or amphoteric emulsifiers there may be used for example: quaternized amine alkoxylates, alkylbetaines, alkylamino betaines and sulfobetaines.

Typical protective colloids are for example cellulose derivatives, polyethylene glycol, polypropylene glycol, copolymers of ethylene glycol and propylene glycol, polyvinyl acetate, polyvinyl alcohol, polyvinyl ethers, starch and starch derivatives, dextran, polyvinylpyrrolidone, polyvinylpyridine, polyethyleneimine, polyvinylimidazole, polyvinylsuccinimide, polyvinyl-2-methylsuccinimide, polyvinyl-1,3-oxazolid-2-one, polyvinyl-2-methylimidazoline and maleic acid or maleic anhydride copolymers as described for example in DE-A 2501123.

The emulsifiers or protective colloids are customarily used in concentrations from 0.05% to 20% by weight, based on the monomers.

The textile structures of the present invention may also comprise combinations of aqueous emulsions of (co)polymers of at least one ethylenically unsaturated monomer MON on the one hand and granular superabsorbent polymers based on partially neutralized crosslinked polyacrylic acids on the other. The superabsorbent partially neutralized polyacrylic acids may be crosslinked with customary crosslinkers, which preferably have at least two ethylenically unsaturated double bonds, one ethylenically unsaturated double bond and one further functional group or else two functional groups. The functional groups of these crosslinkers should be capable of reacting with the acid groups of acrylic acid. Examples of suitable functional groups are hydroxyl, amino, epoxy and aziridino groups. The granular superabsorbent polymers based on partially neutralized crosslinked polyacrylic acids typically have particle sizes in the range from 200 to 800 mm.

It may also be advisable for the water-remote side of the present invention's textile structures formed from fibers and/or ribbons and also swellable materials to have a mixture of granular superabsorbent polymers based on partially neutralized crosslinked polyacrylic acids on the one hand and a powder of polymers on the other applied to it. Suitable for this purpose are in particular thermoplastic powders of polyolefins such as polyethylene or polypropylene. A blend ratio between the granular superabsorbent polymer and the polymer powder should be maintained in the range from about 0.5:1 to 5:1 and especially in the range from 1:1 to 3:1. The thus obtained mixture of granular superabsorbent polymer and the polymer powder may then be covered with a textile structure which has a basis weight of about 50-80 g/m$^2$ and an effective aperture size of less than 0.12 mm and subsequently be bonded by heat and pressure to the textile structure of the present invention. This ensures that, in the installed state, the swollen swellable material of the textile structure according to the present invention can support itself against the likewise swollen granular superabsorbent polymer. This prevents the swellable material being flushed out of the textile structure.

The textile structures of the present invention may be made, inter alia, by applying the swellable materials to the fibers and/or ribbons by coating, impregnating, padding, foaming or spraying.

When the textile structure is a fiber web, it is also possible to employ a Maliwatt process. In this process, a membrane of fibers laid down at right angles to the machine direction is consolidated by stitchbonding the fibrous plies together with external yarn in the longitudinal direction at a spacing of about 1 mm. This fibrous layer is then impregnated with the swellable material.

Instead of a fiber web, the textile structure may also be a woven fabric.

The textile structures of the present invention may form parts of seals which are likewise of the present invention and which, as well as the textile structure, comprise at least one sealing membrane composed of plastics. Preference is given to an arrangement in which the sea comprises a textile structure which is disposed between two sealing membranes composed of plastics. The textile structure may be secured to the sealing membranes in a conventional manner, for example by hook engagement, adhering, tieing or by calendering/welding under pressure and heat.

The textile structure of the present invention may be used inter alia as a sealing material for road, tunnel and water engineering and also for excavations, high-water protection and roof sealing systems. Specifically in the case of excavations, in road engineering and high-water protection, the textile structure of the present invention may also be used either a one or else combined with mixtures of granular superabsorbent polymers and powders of other polymers.

Conceivable arrangements include in particular the installation of the textile structure underneath a sealing membrane of plastic, against the built structure to be protected, to prevent underseepage in the event of damage to the sealing membrane, for example for flat roofs in building construction, in the case of tunnels in open construction and also in the case of seals for subbasements or underground carparks.

Other possible applications for the textile structure relate to its use between two sealing membranes as self-healing seals in tunnel engineering (as per DE-A 19625245) and also as part of a membrane tanking system in traffic route engineering (as per DE-A 19930701) or in building and civil engineering.

Further possible applications for the textile structure according to the present invention relate to its installation underneath the concrete protective layer for a plastics sealing membrane in basins and channels to prevent percolate flow underneath the concrete slabs to damaged sites in the plastics seal and to reduce the stress in the concrete slabs through reduced friction. Examples thereof will include the installation of the textile structures in rainwater retention basins, agricultural ponds, sludge basins and also in irrigation and power plant channels in the case of coarsely granular soils.

It is further conceivable to install the textile structure either alone or else in conjunction with other sealing membranes in soil instead of clay sealing membranes, especially in irrigation and discharge channels, for sealing agricultural ponds, storage ponds or pollution control areas, for creating artificial groundwater carriers and for the first sealing of membrane tanking systems and excavations.

The textile structures of the present invention may also be used in combination with protective nonwovens which are used to protect seals. Such protective nonwovens do not hinder the flow of water to the damaged site in the case of damage in the seal in granular soils (vertical perviousness). In the case of firmer soils, they promote the collection and distribution of the water flowing through the site of damage (horizontal perviousness). The textile structure of the present invention when used in this function enhances safety by virtue of its sealing performance.

A further way of using the textile structure of the present invention is to use it as a lining and seal in wire baskets which are rapidly set up as a temporary high-water barrier or in water engineering and then filled mechanically with spall, gravel or recyclate.

Further possible uses for the textile structures of the present invention are as cable sheaths; in packaging, for example as pad inserts to absorb liquid, for frozen goods, as a moisture donor for "fresh products", in refuse bags, as biotub or refuse can inserts, as filter materials, for example as filter mats for air conditioners or for oil dewatering in gasoline tanks or for hydraulic oils or as motor fuel filters; for geotextiles or in the agri sector, for example as a covering for landfills, for idled mines, as a component of vegetated cover systems for flat roofs, embankments or noise protection walls; for levee construction, in the hygiene or medical sector, in the textile or fire protection sector.

The textile structures of the present invention are superior to prior art textile wovens or nonwovens, inter alia because of superior processability (machine laying is a possibility) and swellability and also higher water imperviousness, including especially in the horizontal direction. When the textile structure is installed as a protective ply, it prevents the spreading of water and by virtue of its buffering action provides greater safety against customary damage. This is the result of the fibers or ribbons which are present being completely encased by materially bound water, so that no water-ducting layers are formed. Furthermore, they are very readily laminable with sealing membranes.

EXAMPLE

I. Production of Aqueous Emulsion to be Used in the Present Invention Examples The water-soluble polymers which are used according to the present invention in the examples had the following composition:

Stabilizer 1: graft polymer of vinyl acetate on polyethylene glycol of molecular weight $M_N$ 6000, polymer concentration 20%

Stabilizer 2: hydrolyzed copolymer of vinyl methyl ether and maleic anhydride in the form of the free carboxyl groups, polymer concentration 35%

Stabilizer 3: copolymer of methyl polyethylene glycol methacrylate and methacrylic acid of molar mass $M_w$ 1500, polymer concentration 40%

Stabilizer 4: polypropylene glycol having a molecular weight $M_N$ of 600

Stabilizer 5: polypropylene glycol having a molecular weight $M_N$ of 900

Stabilizer 6: onesidedly methyl end group capped polypropylene glycol having a molecular weight $M_N$ of 1000

Stabilizer 7: block copolymer of polyalkylene glycols having a molecular weight $M_N$ of 1000

Stabilizer 8: maltodextrin (C-PUR01910, 100%)

Stabilizer 9: onesidedly methyl end group capped polypropylene glycol having a molecular weight $M_N$ of 2000

The examples utilized the following polymerization initiators:

Azostarter VA-044: 2,2'-azobis(N,N'-dimethyleneisobutyramidines) dihydrochloride Azostarter V-70: 2,2'-azobis(4-methoxy-2,4-dimethylaleronitrile)

Azostarter V-65: 2,2'-azobis(2,4-dimethylaleronitrile)

Example 1

A 250 ml capacity four neck flask equipped with a Teflon stirrer and a device for working under nitrogen was charged under a stream of nitrogen with 90.0 g of stabilizer 1,
51.4 g of stabilizer 2 and
28.6 g of completely ion-free water and the initial charge was stirred at 300 rpm. To this solution were added dropwise over 5 to 10 minutes, 30 g of acrylic acid before the mixture was heated to 50° C., a which point 0.03 g of 2,2'-azobis(N,N'-dimethyleneisobutyramidines) dihydrochloride (Azostarter VA-044) was added and the mixture was polymerized at 50° C. for 5 hours. The reaction mixture was then admixed with 0.05 g of Azostarter VA-044 and supplementary polymerized at 60° C. for 1 hour to obtain an aqueous dispersion having a solids content of 33%, a pH of 4 and a viscosity of 5950 mPas. The polymer had a K value of 120.7. Water was added to the dispersion to prepare a 2% aqueous solution. It had a viscosity of 2640 mPas coupled with a pH of 7.

The particle size distribution of the dispersed particles of the polymer dispersion was in the range from 3 to 8 μm.

Example 2

The apparatus indicated in Example 1 was charged with
90.0 g of stabilizer 1,
51.4 g of stabilizer 2 and
28.6 g of completely ion-free water and the initial charge was stirred at 300 rpm while nitrogen was passed through. To this solution was added dropwise, over 5 to 10 minutes, a mixture of 30 g of acrylic acid and 0.09 g of triarylamine crosslinker and the mixture was heated to a temperature of 40° C. over 5 to 10 minutes, at which point 0.03 g of 2,2'-azobis(4-methoxy-2,4-dimethylvaleronitrile) (Azostarter V-70) was added and the mixture was polymerized at a temperature of 40° C. for 5 hours. 0.05 g of Azostarter V-70 was then added for supplementary polymerization, and the dispersion was heated to a temperature of 5000 for one hour to obtain an aqueous dispersion having a viscosity of 2700 mPas and a pH of 4. Water was added to the aqueous dispersion to prepare a 2% aqueous solution. It had a viscosity of 39 000 mPas coupled with a pH of 7.

The particle size distribution of the dispersed particles of the dispersed pales the polymer dispersion was in the range from 5 to 60 μm.

Example 3

Example 2 was repeated with the exceptions that the polymerization apparatus was charged with
12 g of stabilizer 4,
51.4 g of stabilizer 2 and
106.6 g of completely ion-free water and no triallylamine was used. The aqueous emulsion obtained had a viscosity of 2240 mPas coupled with a pH of 4.

Example 4

The apparatus indicated in Example 1 was charged with
1.5 g of stabilizer 5,
16.5 g of stabilizer 4
18.0 g of stabilizer 8 and
104.0 g of completely ion-free water, the mixture was continuously stirred at 300 rpm and 30 g of acrylic acid were added continuously over 5 to 0 minutes. The pH of the reaction mixture was then adjusted from 4.5 to 3 by addition of 30 g of 32% hydrochloric acid and the emulsion was heated to a temperature of 50° C. After addition of 0.03 g of Azostarter VA-044 the emulsion was polymerized at 50° C.

for 5 hours, at which point 0.05 g of Azostarter VA-044 were added before the mixture was supplementary polymerized at 50° C. for 1 hour to obtain an aqueous dispersion having a viscosity of 208 mPas.

Example 5

Example 1 was repeated with the exceptions that the polymerization apparatus was charged with a mixture of 45 g stabilizer 3

51.4 g stabilizer 2 and 73.6 g of completely ion-free water.

An aqueous emulsion having a viscosity of 3650 mPas was obtained. The particle size distribution of the dispersed particles of the polymer dispersion was in the range from 3 to 10 μm.

Example 6

The apparatus indicated in Example 1 was charged with 90.0 g of stabilizer 1, 51.4 g of stabilizer 2 and 28.6 g of completely ion-free water and the initial charge was stirred at 300 rpm while nitrogen was passed through. To this solution was added dropwise, over 5 to 10 minutes, a mixture of 30 g of acrylic acid and 0.22 g of pentaerythritol triallyl ether (70%) crosslinker and the mixture was heated to a temperature of 40° C. over 5 to 10 minutes, at which point 0.03 g of Azostarter V-70 was added and the mixture was polymerized at a temperature of 40° C. for 5 hours. 0.05 g of Azostarter V-044 was then added for supplementary polymerization, and the dispersion was heated to a temperature of 50° C. for one hour to obtain an aqueous dispersion having a viscosity of 2900 mPas. Water was added to the aqueous dispersion to prepare a 2% aqueous solution. It had a viscosity of 10 000 mPas coupled with a pH of 7. The particle size distribution of the dispersed particles of the polymer dispersion was in the range from 5 to 70 μm.

Example 7

A 250 ml capacity four neck flask equipped with a Teflon stirrer and a device for working under nitrogen was charged under a stream of nitrogen with 90.0 g of stabilizer 1, 18.0 g of stabilizer 8 and 62.0 g of completely ion-free water and the initial charge was stirred at 200 rpm. To this solution were added dropwise, over 5 to 10 minutes, 30 g of acrylic acid before the mixture was heated to 50° C., at which point 0.03 g of Azostarter VA-044 was added and the mixture was polymerized at 50° C. for 5 hours. The reaction mixture was then admixed with 0.05 g of Azostarter VA-044 and supplementary polymerized at 60° C. for 1 hour to obtain an aqueous dispersion having a solids content of 33%, a pH of 2 and a viscosity of 10 500 mPas. Water was added to the dispersion to prepare a 2% solution. It had a viscosity of 2000 mPas coupled with a pH of 7. The particle size distribution of the dispersed particles of the polymer dispersion was in the range from 5 to 40 μm.

Example 8

The apparatus indicated in Example 1 was charged with 90.0 g of stabilizer 1, 51.4 g of stabilizer 2 and 28.6 g of completely ion-free water and the initial charge was stirred at 300 rpm while nitrogen was passed through. To this solution was added dropwise, over 5 to 10 minutes, a mixture of 30 g of acrylic acid and 0.09 g of triallylamine crosslinker and the emulsion was heated to a temperature of 50° C. over 5 to 10 minutes, at which point 0.03 g of Azostarter V-65 was added and the mixture was polymerized at a temperature of 50° C. for 5 hours. 0.05 g of Azostarter V-044 was then added for supplementary polymerization, and the dispersion was heated to a temperature of 60° C. for one hour to obtain an aqueous dispersion having a viscosity of 3700 mPas and a pH of 4. Water was added to the aqueous dispersion to prepare a 2% aqueous solution. It had a viscosity of 29 000 mPas coupled with a pH of 7. The particle size distribution of the dispersed particles of the polymer dispersion was in the range from 5 to 30 μm.

Example 9

The apparatus indicated in Example 1 was charged with 90.0 g of stabilizer 1, 45.7 g of stabilizer 2 and 34.3 g of completely ion-free water and the initial charge was stirred at 300 rpm while nitrogen was passed through. To this solution was added dropwise, over 5 to 10 minutes, a mixture of 30 g of acrylic acid and 0.09 g of trialkylamine crosslinker and the mixture was heated to a temperature of 4000 over 5 to 10 minutes, at which point 0.03 g of Azostarter V-70 was added and the mixture was polymerized at a temperature of 40° C. for 5 hours. 0.05 g of Azostarter V-044 was then added for supplementary polymerization, and the dispersion was heated to a temperature of 50° C. for one hour to obtain an aqueous dispersion having a viscosity of 2300 mPas. Water was added to the aqueous dispersion to prepare a 2% aqueous solution. It had a viscosity of 32 000 mPas coupled with a pH of 7.

Example 10

The apparatus indicated in Example 1 was charged with 18.0 g of stabilizer 9, 18.0 g of stabilizer 8 and 90.0 g of completely ion-free water, the mixture was continuously stirred at 300 rpm while passing nitrogen through and 30 g of acrylic acid were added continuously over 5 to 10 minutes. The pH of the reaction mixture was then adjusted from 4.5 to 3 by addition of 30 g of 32% hydrochloric acid and the emulsion was heated to a temperature of 50° C. After addition of 0.03 g of Azostarter VA-044 the emulsion was polymerized at 50° C. for 5 hours, at which point 0.05 g of Azostarter VA-044 was added before the mixture was supplementary polymerized at 50° C. for 1 hour to obtain an aqueous dispersion having a viscosity of 320 mPas.

Example 11

The apparatus indicated in Example 1 was charged with 63.0 g of stabilizer 7

9.0 g of stabilizer 8

400 g of water and 45 g of acrylic acid and this initial charge was stirred at 100 rpm while nitrogen was passed through. To this a solution were added 0.45 g of sodium persulfate and 14.4 g of water and the mixture was incipiently polymerized at 25° C. for 15 minutes. Then 135 g of acrylic acid and 27 g of stabilizer 8 were added at 25° C. over 2 hours. At the same time, 0.18 g of ascorbic acid was added over 7 hours. The batch was subsequently subjected to supplementary polymerization for one hour to obtain an aqueous dispersion having a viscosity of 800 mPas and a pH of 1.5. Water and aqueous sodium hydroxide solution were added to obtain a 2% dispersion having a pH of 7 and a viscosity of 5000 mPas.

Example 12

Polymerization of Crosslinked Acrylic Acid in the Presence of Maleic Acid-Vinyl Methyl Ether Copolymer and Vinyl Acetate-PEG 6000 Copolymer 449 g of copolymer of maleic acid and vinyl methyl ether (20% by weight in water), 257 g of copolymer of vinyl acetate and polyethylene glycol 6000 (35% by weight in water) and 102.5 g of water are added together and flooded with nitrogen for 10 minutes with stirring 60 g of acrylic acid (100%) are then added over 10 minutes with stirring, and the reaction mixture is heated to 60° C. under a permanent nitrogen atmosphere.

On attainment of the desired internal temperature, the simultaneous addition is commenced of on the one hand a solution of 90 g of acrylic acid (100%) and 1.5 g of Laromer® 9015x (ETMPTA) (from BASF) and on the other a solution of free radical starter (VA-044; 0.15 g) and 40 g of water and is continued for 3.5 hours and 4.0 hours respectively.

On completion of the addition the batch is stirred at 60° C. for half an hour and then supplementary polymerized at 60° C. for one hour by addition of further free radical starter (VA-044; 0.015 g).

Cooling to room temperature gives a slightly yellow, viscous, milky cloudy emulsion having a polymer content 15% and a viscosity of 5350 mPas.

Example 13

449 g of copolymer of maleic acid and vinyl methyl ether (20% by weight in water), 257 g of copolymer of vinyl acetate and polyethylene glycol 6000 (35% by weight in water) and 102.5 g of water are added together and flooded with nitrogen for minutes with stirring.

60 g of acrylic acid (100%) and free radical initiator (VA-044; 0.015 g) are then added over 10 minutes with stirring, and the reaction mixture is heated to 60° C. under a permanent nitrogen atmosphere.

On attainment of the desired internal temperature, the simultaneous addition is commenced of on the one hand a solution of 90 g of acrylic acid (100%) and 1.5 g of Laromer® 9015x (ETMPTA) (from BASF) and on the other a solution of free radical starter (VA-044; 0.135 g) and 40 g of water and is continued for 3.5 hours and 4.0 hours respectively.

On completion of the addition the batch is stirred at 60° C. for half an hour and then supplementary polymerized at 60° C. for one hour by addition of further free radical starter (VA-044; 0.015 g).

Cooling to room temperature gives a slightly yellow, viscous, milky cloudy emulsion having a polymer content 15% and a viscosity of 5550 mPas Example 14

449 g of copolymer of maleic acid and vinyl methyl ether (20% by weight in water), 257 g of copolymer of vinyl acetate and polyethylene glycol 6000 (35% by weight in water) and 102.5 g of water are added together and flooded with nitrogen for 10 minutes with stirring.

60 g of acrylic acid (100%) and free radical initiator (VA-044; 0.015 g) are then added over 10 minutes with stirring, and the reaction mixture is heated to 60° C. under a permanent nitrogen atmosphere.

On attainment of the desired internal temperature, the simultaneous addition is commenced of on the one hand a solution of 90 g of acrylic acid (100%) and 1.5 g of triallylamine and on the other of a solution free radical starter (VA-044; 0.135 g) and 40 g of water and is continued for 3.5 hours and 4.0 hours respectively.

On completion of the addition the batch is stirred at 60° C. for half an hour and then supplementary polymerized at 60° C. for one hour by addition of further free radical starter (VA-044; 0.015 g).

Cooling to room temperature gives a slightly yellow, highly viscous, milky cloudy emulsion having a polymer content 15% and a viscosity of 10 250 mPas.

Example 15

449 g of copolymer of maleic acid and vinyl methyl ether (20% by weight in water), 257 g of copolymer of vinyl acetate and polyethylene glycol 6000 (35% by weight in water) and 102.5 g of water are added together and flooded with nitrogen for minutes with stirring.

60 g of acrylic acid (100%) and free radical initiator (VA-044; 0.015 g) are then added over 10 minutes with stirring, and the reaction mixture is heated to 60° C. under a permanent nitrogen atmosphere.

On attainment of the desired internal temperature, the simultaneous addition is commenced of on the one hand a solution of 75 g of acrylic acid (100%), 15 g of methyl methacrylate (100%) and 1.5 g of triallylamine and on the other a solution of free radical starter (VA-044; 0.1359) and 40 g of water and is continued for 3.5 hours and 4.0 hours respectively.

On completion of the addition the batch is stirred at 60° C. for half an hour and then supplementary polymer zed at 60° C. for one hour by addition of further free radical initiator (VA-044; 0.015 g).

Cooling to room temperature gives a slightly yellow, viscous, milky cloudy emulsion having a polymer content 15% and a viscosity of 5800 mPas.

Example 16

449 g of copolymer of maleic acid and vinyl methyl ester (20% by weight in water), 257 g of copolymer of vinyl acetate and polyethylene glycol 6000 (35% by weight in water) and 102.5 g of water are added together and flooded with nitrogen for 10 minutes with stirring.

60 g of acrylic acid 100%) and free radical initiator (V-044; 0.015 g) are then added over 10 minutes with stirring, and the reaction mixture is heated to 6° C. under a permanent nitrogen atmosphere.

On attainment of the desired internal temperature, the simultaneous addition is commenced of on the one hand a solution of 82.5 g of acrylic acid (100%), 7.5 g of methyl acrylate (100%) and 1.5 g of triallylamine and on the other a solution of free radical starter (VA-044; 0.135 g) and 40 g of water and is continued for 3.5 hours and 4.0 hours respectively.

On completion of the addition the batch is stirred at 60° C. for half an hour and then supplementary polymerized at 60° C. for one hour by addition of further free radical initiator (VA-044; 0.015 g).

Cooling to room temperature gives a slightly yellow, highly viscous, milky cloudy emulsion having a polymer content 15% and a viscosity of 21 900 mPas.

II. Use of the Emulsion Obtained after Section I as Constituent of a Swellable Web of Fibers The emulsion obtained from section I was used to produce a swellable web:

Supporting material: a) PET needlefelt (Hildener Filz), about 280-300 g/m$^2$ b) PES webfill, thermally consolidated, about 100-110 g/m$^2$

| Additives: | Run 1 [parts by weight] |
|---|---|
| W/W emulsion (Lutexal ® REVO (fr. BASF)) | X |
| Benz padder speed: | 1 m/min |
| Benz padder pressure: | 45 scale divs |
| Drying: | 7 min/170° C. color: old pink |
| Solids add-on [%]: | |
| Needlefelt | 40 |
| Webfill | 260 |
| Hand assessment | harsh |
| Wetting speed in water | <1 min |
| Water uptake after 1 h immersion [%]: | |
| a) Needlefelt | 835 |
| b) Webfill | 2950 |

The swellable web thus obtained may be used inter alia as a seal for a tunnel. The web is welded into PVC or PET film and is secured with plastics disks to a web of the same kind, but not impregnated with swelling agent (consolidated by mechanical needling) and already installed on the rock-facing side. The interior concrete is then pumped in behind this sandwich (film/swellable web).

We claim:

1. A textile two- or three-dimensional structure formed from fibers and/or ribbons and a swellable material, the fibers and/or ribbons in the structure and also the swellable material each being present in such amounts that the fibers and/or ribbons are encased by the swellable material and voids in the structure are, in the swollen state, partially or completely filled by materially bound water, wherein the swellable material comprises an aqueous emulsion comprising a (co)polymer of at least one ethylenically unsaturated monomer which is applied to the fibers and/or ribbons, wherein the emulsion additionally comprises component (A) which is at least one water-soluble polymer selected from the group consisting of (a1) graft polymers of vinyl acetate and/or vinyl propionate on polyalkylene glycol or one- or both sidedly alkyl-, carboxyl- or amino-substituted polyalkylene glycol, (a2) copolymers of alkylpolyalkylene glycol (meth)acrylates and (meth)acrylic acid, (a3) polyalkylene glycols, and (a4) one- or both sidedly alkyl-, carboxyl- or amino-substituted polyalkylene glycols, and component (B) which is at least one water-soluble polymer selected from the group consisting of (b1) hydrolyzed copolymers of vinyl alkyl ethers and maleic anhydride as a free polyacid or at least partially neutralized with alkali metal hydroxides or ammonium bases, (b2) modified or unmodified starch, and (b3) synthetic copolymers obtainable by copolymerization of (β1) one or more nonionic monoethylenically unsaturated monomers, (β2) one or more cationic monoethylenically unsaturated monomers, or (β3) optionally one or more anionic monoethylenically unsaturated monomers, the molar fraction of cationic monoethylenically unsaturated monomers (β2) interpolymerized in (β3) being higher than the fraction of interpolymerized anionic monoethylenically unsaturated monomers (β3), and wherein the emulsion is obtained by (co)polymerizing said at least one ethylenically unsaturated monomer in the presence of components (A) and (B).

2. The textile structure according to claim 1 in the form of wovens or nonwovens.

3. The textile structure according to claim 1 which comprises filament fibers or staple fibers.

4. The textile structure according to claim 1 which comprises mineral, natural or synthetic fibers.

5. The textile structure according to claim 1 wherein the swellable material is a combination of said aqueous emulsion and a granular superabsorbent polymer based on a partially neutralized crosslinked polyacrylic acid.

6. A process for producing a textile two- or three-dimensional structure according to claim 1, which comprises coating, impregnating, padding, foaming or spraying the fibers and/or ribbons with the swellable material.

7. A sealing material comprising the textile structure according to claim 1.

8. The sealing material according to claim 7 wherein the textile structure also comprises a mixture of granular superabsorbent polymer and a powder of another polymer.

9. An absorbing material comprising the textile structure according to claim 1.

10. The absorbing material according to claim 9 wherein the textile structure also comprises a mixture of granular superabsorbent polymer and a powder of another polymer.

11. A seal comprising a textile structure according to claim 1 and at least one sealing membrane comprising a plastic.

12. The seal according to claim 11 wherein the textile structure is disposed between two sealing membranes comprising a plastic.

13. An aqueous emulsion comprising a (co)polymer of at least one ethylenically unsaturated monomer, wherein the emulsion additionally comprises components (A) and (B) and is obtained by (co)polymerizing said at least one ethylenically unsaturated monomer in the presence of components (A) and (B), wherein component (A) is at least one water-soluble polymer selected from the group consisting of (a1) graft polymers of vinyl acetate and/or vinyl propionate on polyalkylene glycol or one- or both sidedly alkyl-, carboxyl- or amino-substituted polyalkylene glycol, (a2) copolymers of alkylpolyalkylene glycol (meth)acrylates and (meth)acrylic acid, (a3) polyalkylene glycols, and (a4) one- or both sidedly alkyl-, carboxyl- or amino-substituted polyalkylene glycols, and component (B) is at least one water-soluble polymer selected from the group consisting of (b 1) hydrolyzed copolymers of vinyl alkyl ethers and maleic anhydride as a free polyacid or at least partially neutralized with alkali metal hydroxides or ammonium bases, (b2) modified or unmodified starch, and (b3) synthetic copolymers obtainable by copolymerization of (β1) one or more nonionic monoethylenically unsaturated monomers, (β2) one or more cationic monoethylenically unsaturated monomers, or (β3) optionally one or more anionic monoethylenically unsaturated monomers, the molar fraction of cationic monoethylenically unsaturated monomers (β2) interpolymerized in (β3) being higher than the fraction of interpolymerized anionic monoethylenically unsaturated monomers (β3).

14. The textile structure according to claim 1 wherein (A) and (B) are present in a weight ratio of 1:5 to 5:1.

15. The textile structure according to claim 1 wherein (A) and (B) are present in a weight ratio of 1:2 to 2:1.

16. The textile structure according to claim 1 wherein (A) comprises (a1) and (B) comprises (b1).

17. The textile structure according to claim 1 wherein (A) comprises (a2) and (B) comprises (β1).

18. The textile structure according to claim 1 wherein (A) comprises (a3) and (a4), and (B) comprises (β3).

* * * * *